US005507172A

United States Patent [19]

Thompson et al.

[11] Patent Number: 5,507,172

[45] Date of Patent: Apr. 16, 1996

[54] APPARATUS TO MEASURE PARTICLE DISTRIBUTION OF A SHOT STREAM

[75] Inventors: Robert A. Thompson, Quaker Street; Randy S. Brown, Schenectady, both of N.Y.

[73] Assignee: General Electric Company, Schenectady, N.Y.

[21] Appl. No.: 313,952

[22] Filed: Sep. 28, 1994

[51] Int. Cl.[6] ..... B24C 1/10

[52] U.S. Cl. ..... 73/11.02

[58] Field of Search ..... 73/11.02, 863.31, 73/863.52, 864, 864.64, 28.01, 28.04, 28.05, 202, 861.39, 861.41, 865.9; 72/53

[56] References Cited

U.S. PATENT DOCUMENTS 3,472,080 10/1969 Webb ..... 73/28.01
4,569,236 2/1986 Kitchen et al. ..... 73/863.31
4,848,123 7/1989 Thompson ..... 73/11.02
5,005,431 4/1991 Cordera ..... 73/863.53
5,226,331 7/1993 Thompson et al. .

*Primary Examiner*—R. Raevis
*Attorney, Agent, or Firm*—Paul R. Webb, II

[57] ABSTRACT

A novel apparatus capable of measuring distribution of a shot stream is disclosed. More particularly, the apparatus comprises an elongated measurement window positioned within a partition plate. Said elongated measurement window being partitioned into smaller sub-windows, each of which is capable of collecting shot from an area of a shot stream to be measured. This measurement may then be used to determine the peening time needed to fully cover each element of a part's surface with impact dents during a shot peening operation.

13 Claims, 7 Drawing Sheets

APPARATUS TO MEASURE PARTICLE DISTRIBUTION OF A SHOT STREAM

BACKGROUND OF THE INVENTION

This invention relates to a novel apparatus capable of measuring distribution of a shot stream.

During a shot peening process, a stream of shot (i.e., particles), traveling at a high velocity, is directed at a workpiece surface. The shot is directed at the workpiece so as to cause plastic deformation of the workpiece surface, which often is a metal surface. Although this process may be applied for other purposes, the shot peening process generally is used to increase fatigue strength of the workpiece.

Two key drivers govern the shot peening process. They are intensity, the impact energy of individual shot particles, and coverage, the way individual strikes add to fully cover the surface with a compressive residual stress layer.

Under normal shot peening conditions, it is desirable to expose the substrate or work surface to the shot stream for a sufficient time to achieve 100% surface coverage, or sufficient exposure to fully cover the surface with impact dimples. Insufficient coverage has obvious adverse consequences. If the local compressive zones, due to individual shot strikes, do not merge into a continuum that fully covers the surface with a compressive layer, locally unprotected regions will exist which may cause some regions of the surface to remain in tension and become crack initiation sites.

On the other hand, shot peening related damage may also be caused by excessive shot peening, leading to immoderate cold work. The cold work sustained by the material is a function of both coverage and intensity, as well as shot size. To minimize damage age due to excessive cold work, or prevent under worked parts form entering service, it is desirable to measure the coverage.

For uniform flat surfaces it is relatively easy to set and control the exposure time needed to maintain the desired coverage condition. However, on surfaces with features, such as inside corners where reflections cause multiple strikes, it may be difficult to avoid excessive coverage, in some cases to the point where surface distress may occur.

Certain measurement techniques have been used in conjunction with the shot peening process, however, such prior techniques have been inadequate to conveniently and inexpensively provide an indication of the quality of a shot peening technique. The general absence of simple and inexpensive techniques to measure the quality of shot peening inhibits one's confidence that consistent shot peening results may be obtained.

It is apparent from the above that there exists a need in the art for a quick, inexpensive, and relatively accurate apparatus for measuring shot stream particle density distributions in order to evaluate the coverage on a Substrate surface in a manner which provides a full and complete analysis of the coverage. It is a purpose of this invention to fulfill this and other needs in the art in a manner more apparent to the skilled artisan once given the following disclosure.

SUMMARY OF THE INVENTION

The above-mentioned needs are met by the present invention which relates to a novel apparatus which may be used to measure distribution of a shot stream. More particularly, the apparatus comprises an elongated measurement window positioned within a partition plate. Said elongated measurement window being partitioned into smaller sub-windows, each of which is capable of collecting shot from an area of a shot stream for measurement. This measurement may then be used to determine the peening time needed to fully cover each element of a part's surface with impact dents during a shot peening operation as described in what follows.

In certain preferred embodiments, the apparatus further includes reinforcing rods, flexible adapter tubes, a collection box, thin-wall tubes, collection vials, and a foam rubber sheet fixedly attached to allow air to escape from the collection vials.

The preferred apparatus, according to this invention, offers the following advantages: easy assembly and repair; excellent particle distribution measurement characteristics; good stability; good durability; and good economy. In fact, the qualities of excellent particle distribution measurement, low cost, and ease of assembly and repair are optimized, in the instant invention, to an extent considerably higher than heretofore achieved in prior, known particle distribution measurement devices.

Other objects and advantages of the present invention will become apparent upon reading the following detailed description and the appended claims with reference to the accompanying drawings.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
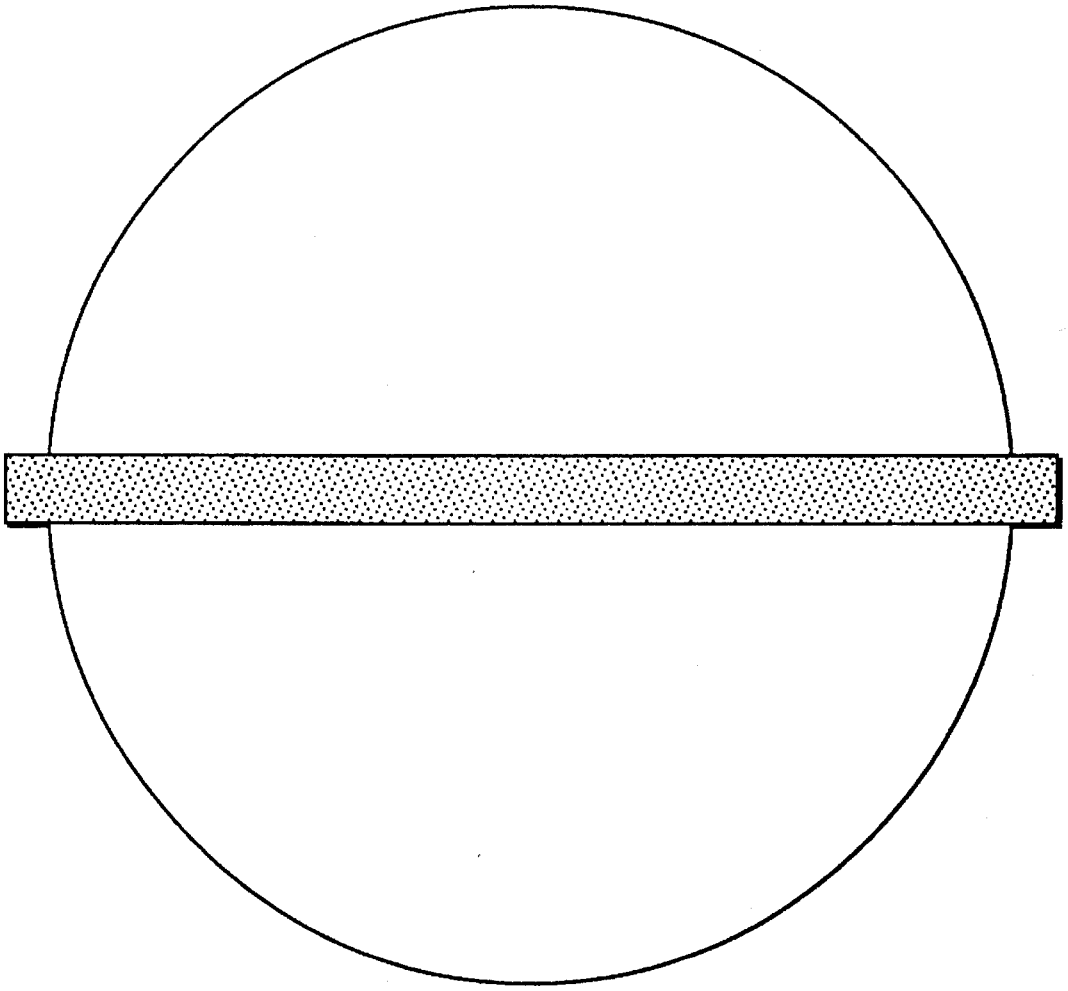
FIG. 1 illustrates a shaded area signifying a sufficient measurement section for axisymmetric streams.

In most cases, the distribution of particles in a shot stream is, to a good approximation, axisymmetric about a stream center. Therefore, the shot distribution on any given diameter is essentially the same as any other and is sufficient to fully describe a given shot stream. FIG. 1 illustrates a sufficient measurement of axisymmetric streams. Here the measurement is made along the narrow shaded area. In cases where axisymmetry does not adequately describe the stream, the measurement window is moved by steps along chards of the shot stream or rotated about the stream center.

To assure the correct amount of coverage, it is necessary that each element of surface area be struck by the right number of randomly directed particles having a correct speed. The statistical nature of the manner in which coverage builds up can be described by a brief mathematical explanation.

Statistical evaluation of the shot peening process predicts the relation between coverage and the number of randomly directed shot strikes. It can be shown that an exponential relation exists between the covered area and the dimple area induced by shot strikes. The relation is:

$$a/A=1-e^{-A_tN/A}$$

where:

a=Covered area ($in^2$)

Figure 2:
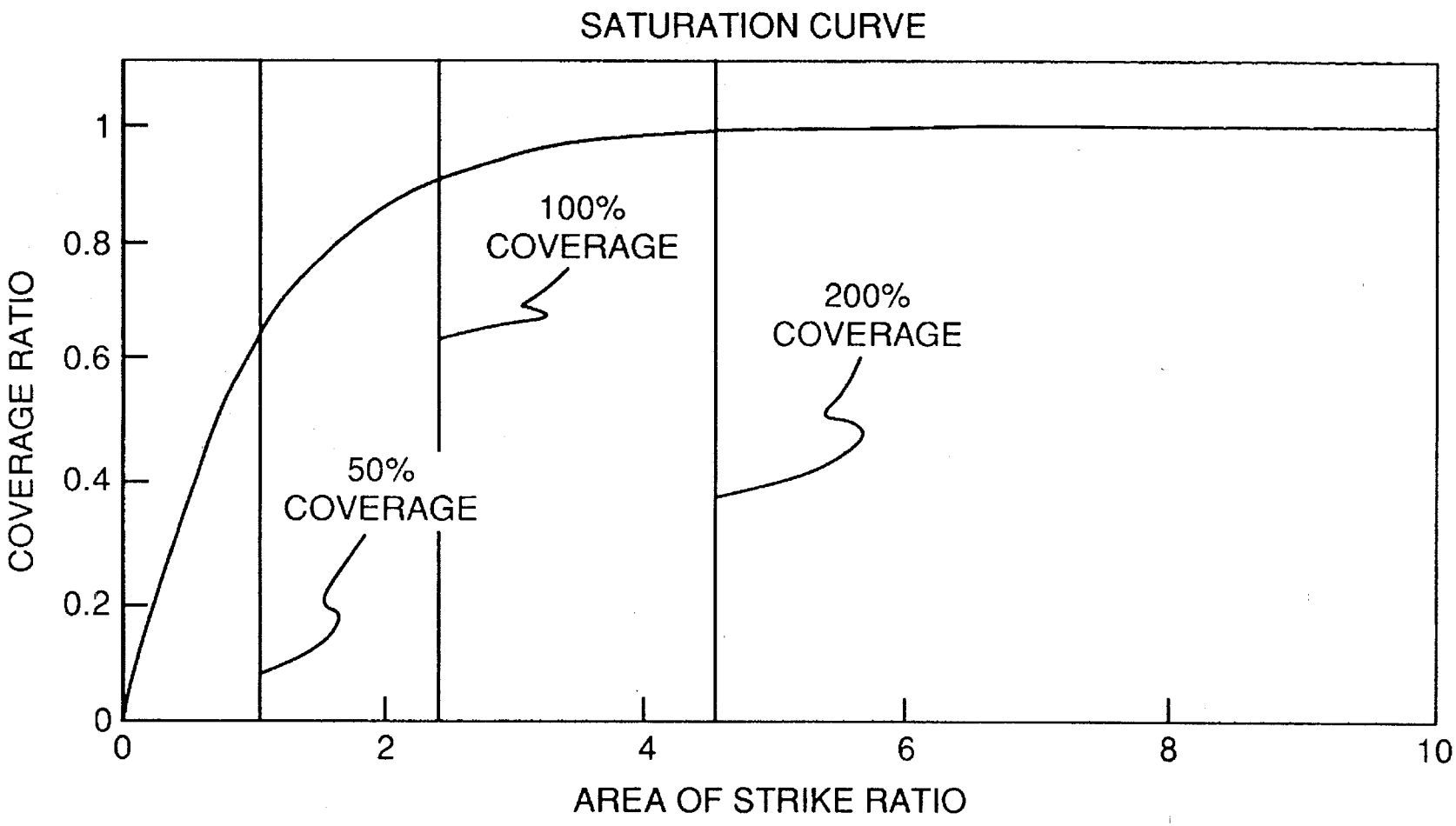
FIG. 2 is a graph showing a plot of the coverage ratio versus the area of strike ratio.

A=Element of area being peened $A_t$=Shot strike dimple area ($in^2$) which depends on shot speed, size density and part yield N=Total number of shot strikes which depends on shot stream particle density distribution and gun trajectory a/A=Coverage ratio $A_tN/A$=Area of strike ratio FIG. 2 shows the relationship between the coverage ratio and the area of strike ratio.

Coverage is controlled by the area of individual dimples and the number or particles that strike the surface. Particle energy, as embodied in size, density, and speed are the main factors in controlling dimple size, while the number rate and particle distribution in the stream, as well as the gun motion, control the total number of strikes, N.

Figure 3:
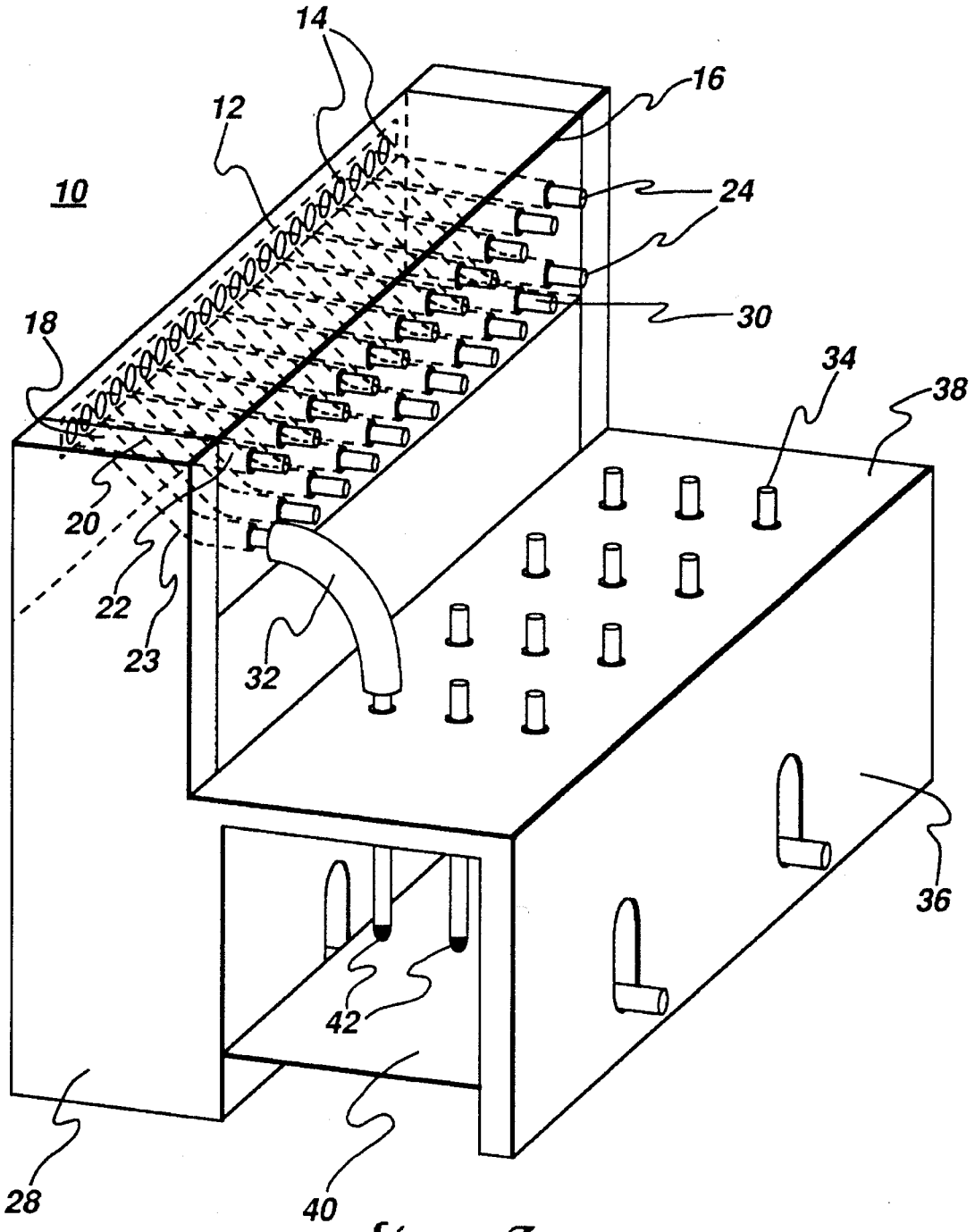
FIG. 3 is a perspective view of an embodiment of a novel apparatus for measuring distribution of a shot stream.

With this background in mind, FIG. 3 of the drawings depicts an apparatus 10 for measuring particle distribution of a shot stream.

Figure 4:
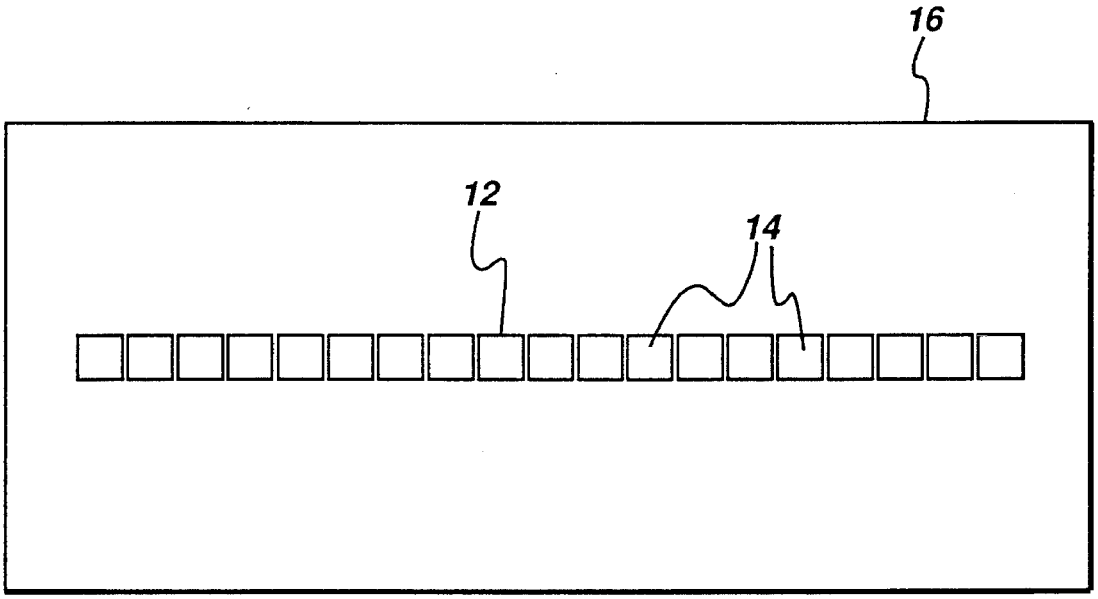
FIG. 4 shows an elongated measurement window divided into a multiplicity of sub-windows positioned within a partition plate in accordance with the instant invention.

Said apparatus 10 comprises an elongated measurement window 12, generally rectangular in shape, which is partitioned into a multiplicity of sub-windows 14, preferably numbering twenty-three. Said elongated measurement window 12 is positioned within a partition plate 16. FIG. 4 depicts said elongated measurement window 12 partitioned into a multiplicity of sub-windows 14, positioned within said partition plate 16.

Each sub-window 14 is comprised of a sub-window entry area 18, a channel area 20, and a sub-window exit area 22. The size of said sub-windows 14 is chosen such that particle flow is not greatly effected by the partitioning wails between said sub-windows 14, or in extreme cases, by particles that are too large to enter said sub-windows 14. Furthermore, if said sub-windows 14 are too large, a measurement will not yield the needed resolution for accurately determining the characteristics of a stream's distribution, and thus, the number of shot strikes at each point on a work surface. Said sub-windows 14 have a preferred shape of a 0.175 inch by 0.175 inch square.

Said partition plate 16 may be case in a mold from a specified material. The preferred specified material is often a rubbery polymer latex such as silicone rubber and the like.

In order to fabricate a mold from the specified material, a multiplicity of rods (not shown in drawings) Should be inserted into the specified material of the partition place 16. Said rods defining the area of said sub-windows 14, including said sub-window entry area 18, channel area 20, and the sub-window exit area 22. Said channel area 20 runs through the thickness of said partition plate 16. Half of said rods may be angled within said partition plate 16 forming a multiplicity of angled channel areas 23 which run through said partition plate 16. The preferred angle of the angled channel areas 23 is 30°. The rods are bent in order to separate the particle flow into two separate rows 24, to facilitate the collection of shot for measurement. Once the mold of the partition plate 16 has properly set, the rods and angled rods should be removed.

One or more reinforcing rods (not shown), frequently two, may be positioned within said specified material of the partition plate 16 prior to molding. Said reinforcing rods run longitudinally throughout the partition plate 16. The reinforcing rods may be tapped to allow said partition plate 16 to be fixedly attached to a means of support 28. The means of support 28 is often a frame.

Preferably the reinforcing rods should be bent on a 5 inch radius so chat said elongated measurement window 12 assumes the same 5 inch, radius of curvature. This structure is desirable because it allows said sub-windows 14 to be equidistant from a shot peening gun when said peening gun is positioned at a distance equal to the radius of curvature of the reinforcing rods, in this instance 5 inches. Such a structure is desirable because it gives each sub-window 14 equal collection properties relative to the other sub-windows 14.

Furthermore, because said partition plate 16 is flexible, the curvature of said reinforcing rods can be set to adapt said apparatus 10 to most spacing schemes.

A multiplicity of adapter tubes 30 are positioned within said channel areas 20 and said angled channel areas 23 and extend outwardly through said sub-window exit areas 22. Said adapter tubes 30 having a sufficiently large diameter such that a transition from the channel areas 20 and the angled channel areas 23 is smooth. A multiplicity of connector hoses 32 are connected to said adapter tubes 30 at the end which extend outwards from said sub-window exit areas 22. Said connector hoses 32 are connected, at the other end, to a multiplicity of thin wall tubes 34, said connector hoses 32 fluidly connecting said thin wall tubes 24 with said channel areas 20 and said angled channel areas 23.

A collection box 36, having a top plate 38 and a bottom plate 40, is positioned below said channel areas 20 and said angled channel areas 23. Said collection box 36 should be constructed so as to allow said thin wall tubes 34 to be securely fixed within said top plate 38 of said collection box 36. Said thin wall tubes 34 having a preferred size of ¼" outside diameter tubing. Said thin wall tubes 34 are fluidly connected to a plurality of collection containers 42, often vials, which may be positioned on said bottom plate 40 of said collection box 36. Said bottom plate 40 may be spring loaded so as to bias said bottom plate 40 towards said top plate 38 to allow said thin wall tubes 34 to engage said collection containers 42.

A roam rubber sheet (not shown in drawings) may be fixedly attached to the top plate 38 to allow air to escape from said collection containers 42, but prevent the loss of shot.

During operation, a shot peening device will fire shot into said elongated measurement window 12. Said stream of shot will separate within each of the sub-windows 14, entering said sub-window entry areas 18, flowing through said channel area 20 and said angled channel area 23 and leaving said sub-window exit areas 22 into said adapter tubes 30. The shot will leave said adapter tubes 30 and flow through said connector hoses 32 into said thin walled tubes 34. The shot will then pass through said thin walled tubes 34 and accumulate in said collection containers 42 attached to said thin walled tubes 34.

Following operation of the apparatus 10, said bottom plate 40 is forced downward until said collection containers 42 disengage from said thin wall tubes 34, thereby allowing removal of the accumulated shot for collection or measurement. Using this collected shot and the known existence of an axisymmetric distribution, the relative particle distribution can be determined, to a good approximation.

EXAMPLE

A set of experiments were run to reduce the idea described herein to practice. The experiments involved operating a shot peening gun equipped with a shot mass flow sensor for one minute while catching shot with the shot distribution apparatus 10 described here in above.

The mass flow sensor was calibrated in the units of lbs/minute. Therefore, by multiplying by 453 grams/lb the total shot ejected by the gun during the 1 minute test could easily be converted to grams, the unit by which shot was measured in the collection containers 42.

Figure 5:
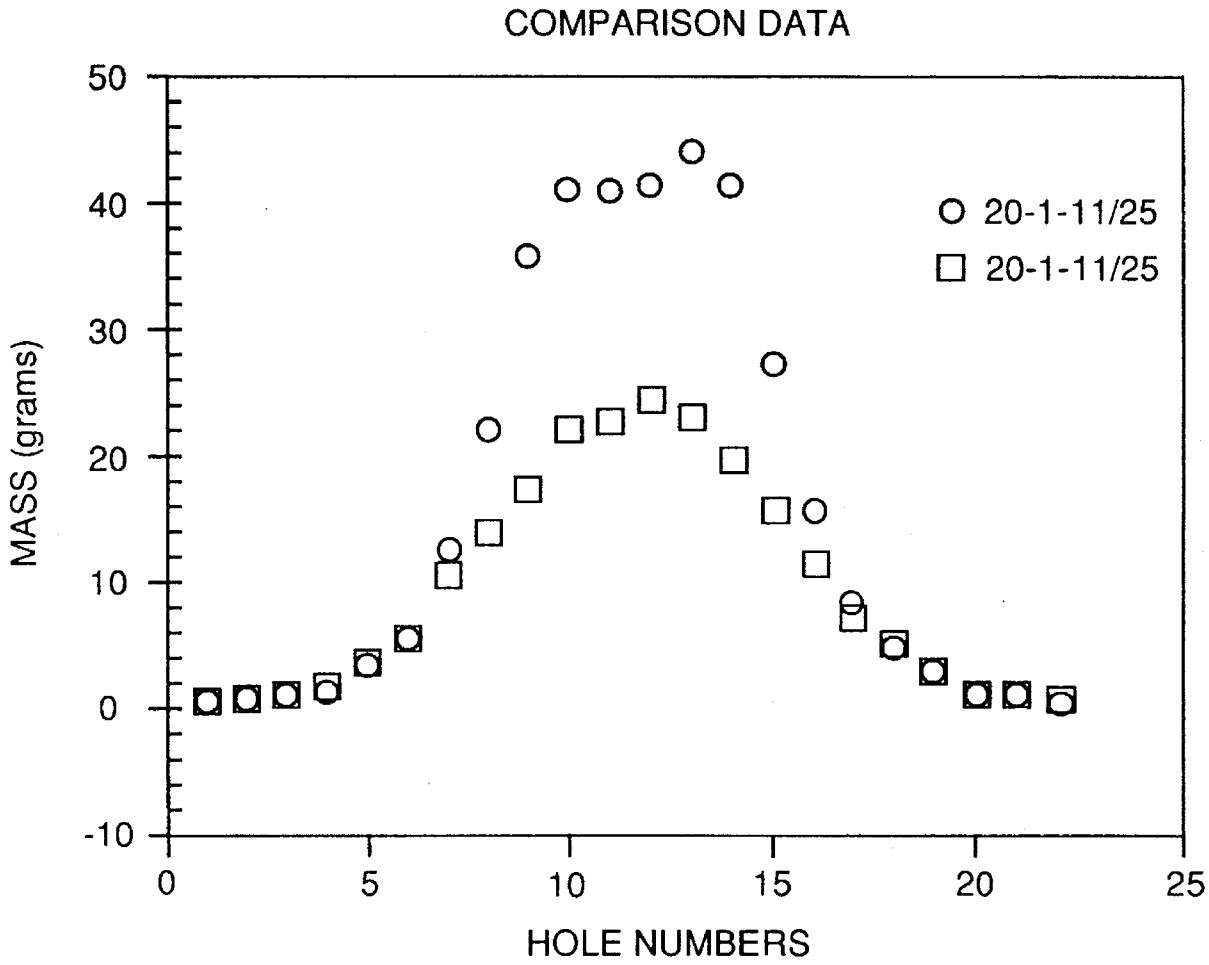
FIG. 5 is a graph showing a plot of the resulting catch in each of 22 vials during a test run at two different nest pressures, 20 psi and 80 psi.

FIG. 5 shows the catch from each of twenty-three sub-windows 14 for two different test conditions:

Test #1 run for 1 minute at 80 psi, using 1 mm diameter shot. Total shot ejected=4800 grams Test #2 run at 20 psi using the same shot and running time. Total shot ejected=3900 grams Sub-windows 14 #1 through #11 were to the left, while sub-windows 14 #13 through #23 were to the right of the shot stream center for each of the tests. Sub-window 14 #12 was at the stream center. Consistent with expectations, the figure shows good symmetry of the grams of shot collected to each side of sub-window 14 #12 for both test conditions.

FIG. 5 shows collected masses of shot ranging from almost zero at the edge of the shot stream to more than 40 grams near the center of the pattern for the 80 psi test and about 24 grams for the 20 psi test.

If account is taken of the effective area of the sub-windows 14 for collecting shot, the quantities of FIG. 5 can be described as a shot density (i.e. grams/in$^2$/minute) for that location in the stream.

Although the nominal sub-window 14 hole sizes were 3/16" (3/16" square rods were used to cast them), their actual measured dimensions were 0.175" square due to shrinkage of the rubber during the curing process.

Figure 6:
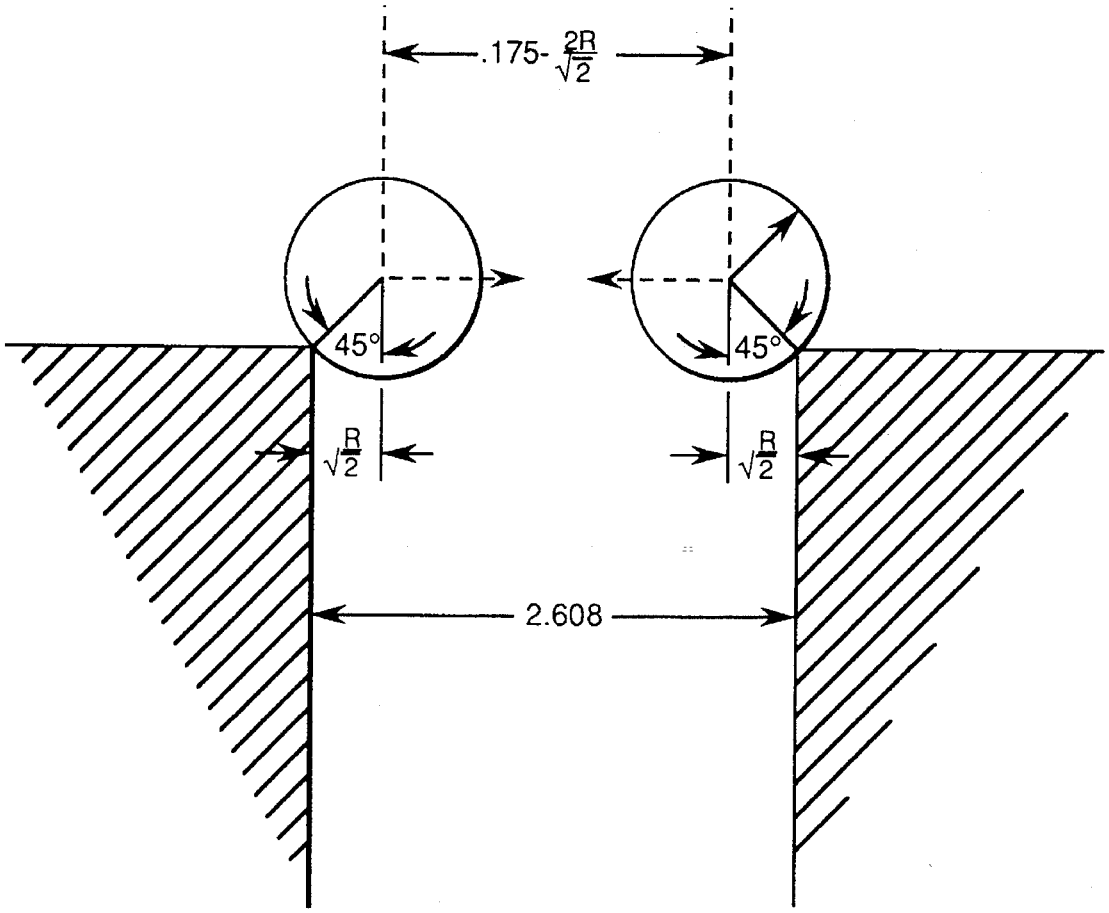
FIG. 6 depicts the deflection of shot from the sub-windows whose tangent to the particle motion is greater than 45°.

Furthermore, the dimensions for capturing shot were further reduced by interaction of the shot particles with the edges of the sub-windows 14, as illustrated by FIG. 6. As shown in FIG. 6, shot incident upon the sub-window 14 edge outside of a point whose tangent to the particle motion is greater than 45°, would bounce in a direction which would prevent said shot from being captured. The 45° tangent occurs at a radial distance of $R\sqrt{2}$ to each side of the sub-windows 14. Therefore, the effective capture area of each sub-window 14 is further reduced by $2R\sqrt{2}$ or $D\sqrt{2}$. Since the shot diameter was 1 mm or 0.039 inches for this set of tests, the effective capture width of each sub-window 14 was $0.175"-0.039\sqrt{2}$ or 0.147 in. Accordingly, the effective capture cross-sectional area was $0.147^2$ or 0.0216 in$^2$.

If this area is divided into the quantities of FIG. 5, the densities at each sub-window 14 in the stream can be determined.

Figure 7:
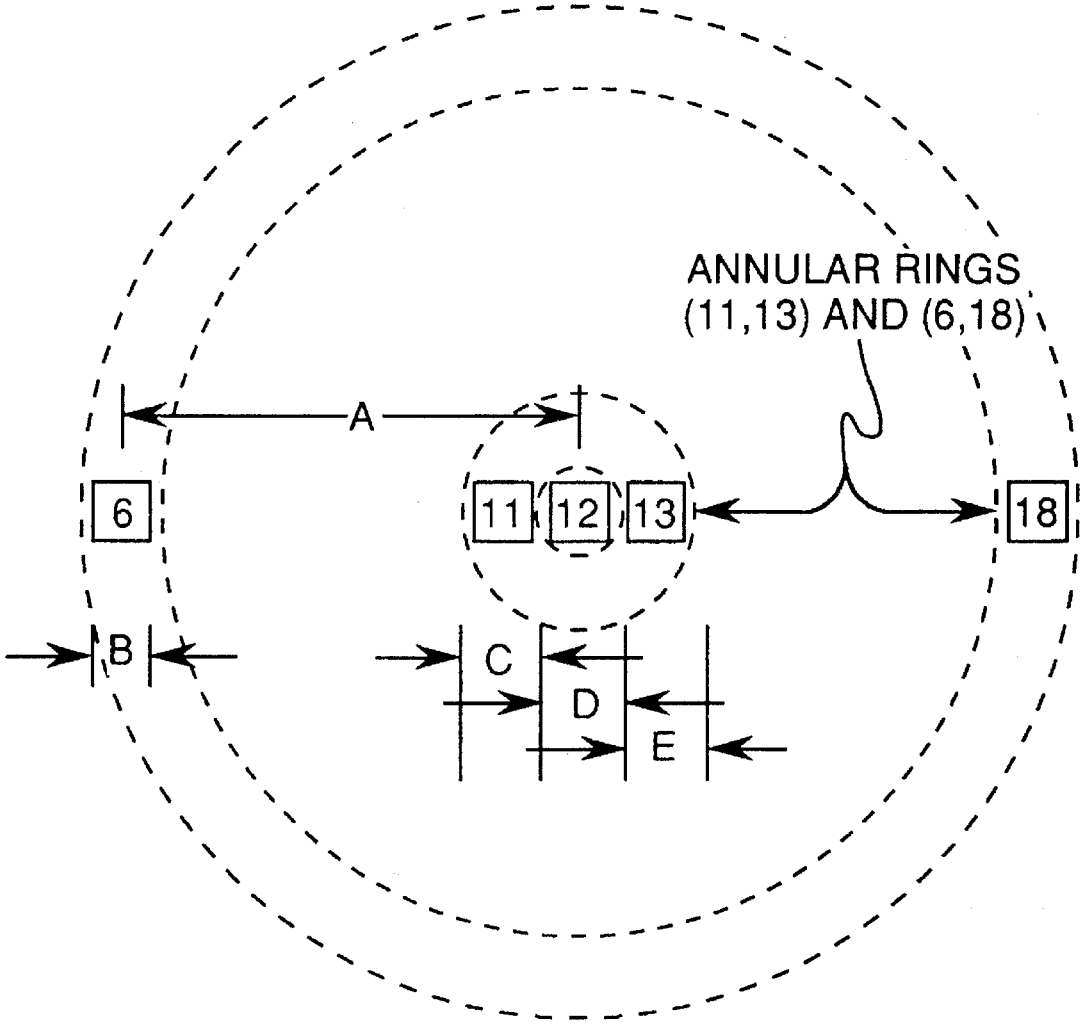
FIG. 7 depicts annular rings associated with sub-window sets in accordance with the instant invention.

If the densities are then averaged to each side of the stream center (sub-window #12), i.e. sub-window #11 is averaged with sub-window #13, and sub-window #10 is averaged with sub-window #14 etc., and the result is multiplied by the area of the annular ring associated with the location of each sub-window 14 set, as shown by FIG. 7, the total flow can be determined.

For example, consider annular ring (sub-windows 14 #6 and #18) of FIG. 7. According to FIG. 5, about 5.5 grams were collected from sub-window 14 #6 and 4.5 grams were collected from sub-window 14 #18, making an average for the annular ring (#6, #18) about 5 grams. Since the area of the sub-windows 14 was 0.0216 in$^2$, the density in the annular ring (#6, #18) was 5 grams/0.0216 in$^2$=231.5 gram/in$^2$.

If this density is multiplied by the area of annular ring (#6, #18), the shot flow through the annular ring can be calculated. Thus, from FIG. 7, $A_{6,18}=2\pi*1.2*2=1.508$ in$^2$. Therefore, the flow through the annular ring (#6, #18) for the one minute test was $m_{6,18}=P_{6,18}*A_{6,18}=231.5$ gram/in$^2$*1.508 in$^2$=349 grams. By a similar procedure, the flow through all of the annular rings can be calculated and added together to find the total stream flow. The flow through the center of the stream at sub-window 14 #12 is determined by multiplying the area of the circle surrounding sub-window 14 #12 by the density calculated for sub-window 14 #12.

Using the data from FIG. 5 the total stream flow was thus calculated for the two example test. The results are as follows:

Test #1 Calculated Mass=4632 grams (80 psi)

Test #2 Calculated Mass=3231 grams (20 psi)

It is clear that the 80 psi case agrees very closely with the value measured by the magnetic flow meter. The 20 psi case on the other hand was about 20% lower than indicated by the flow meter. This error can be attributed to a couple potential sources such as an error in, shot flow measurement for the test, or the fact that the shot flow was assumed to be symmetrical about the stream center when in fact it is often elliptical about the stream center, where in fact the active flow was not symmetric. To capture this elliptical effect more than one line scan across the stream would be required.

While the preferred embodiment of the present invention has been illustrated and described herein, it will be apparent to those skilled in the art that various modifications thereto can be made without departing from the spirit and scope of the invention as defined in the appended claims.

What is claimed is:

1. An apparatus for measuring particle distribution of a shot stream ejected from a gun, comprising:

a partition plate positionable at a distance from said gun and having an elongate measurement window partitioned into a multiplicity of sub-windows positioned therein for receiving distributed portions of said shot stream, a means for collection fluidly connected transversely to said sub-windows in the partition plate for separately collecting said distributed shot stream portions from respective ones of said sub-windows, and means for supporting said plate.

2. An apparatus in accordance with claim 1 further comprising a means including said gun for introducing shot into said apparatus.

3. An apparatus in accordance with claim 2, wherein said means for introducing shot is a shot peening device.

4. An apparatus in accordance with claim 1, wherein said partition plate is made of a rubbery polymer latex.

5. An apparatus in accordance with claim 1, wherein said means for collection is comprised of:

a collection box having a top plate and a bottom plate;

a multiplicity of thin wall tubes fixedly positioned within said top plate;

and a multiplicity of collection containers, wherein said bottom plate is spring loaded so as to bias bottom plate towards said top plate allowing said thin wall tubes to engage said collection containers.

6. An apparatus in accordance with claim 5, wherein said thin wall tubes are ¼" outside diameter tubing.

7. An apparatus in accordance with claim 1, wherein said sub-windows are 0.175" by 0.175" squares.

8. A method for measuring particle distribution of a shot stream using an apparatus comprising: a partition plate, an elongated measurement window in said plate, a multiplicity of sub-windows defined within said window, a collection means joined to said sub-windows, and a means for support of said plate, wherein said method is comprised of the steps:

operating a shot peening device to eject a shot stream;

directing said shot stream into said elongated measurement window for distribution in said sub-windows;

collecting shot from said collection means to determine shot mass for each of said sub-windows;

averaging densities of said shot mass over collection area for each of said sub-windows to each side of a center one of said sub-windows indicative of a shot stream center in a two sub-window set; and multiplying said average density for each set by area of an annular ring associated with said set for determining total flow.

9. An apparatus for measuring distribution of shot particles in a stream ejected from a gun at velocity for plastically deforming a workpiece surface comprising:

a plurality of adjoining sub-windows disposed in a plate positionable at a distance from said gun for receiving distributed portions of said particle stream from said gun aimed thereat;

a plurality of channels extending through said plate in flow communication with respective ones of said sub-windows for channeling away said particles received therein; and a plurality of containers disposed in flow communication with respective ones of said channels for collecting said particles therefrom, with a distribution of said collected particles in said containers being measurable for measuring said distribution of said particles in said stream.

10. An apparatus according to claim 9 further comprising a plurality of conduits disposed below said channels and in flow communication with respective ones thereof for directing said particles to collect in said containers by gravity.

11. An apparatus according to claim 10 wherein said containers are disposed transversely to said channels.

12. An apparatus according to claim 11 wherein said sub-windows are vertical, and said containers are vertical.

13. An apparatus according to claim 10 wherein said plate is rubbery.

* * * * *